United States Patent [19]

Barnett

[11] Patent Number: 4,502,395

[45] Date of Patent: Mar. 5, 1985

[54] COMBUSTION GAS MIXING APPARATUS

[75] Inventor: Stockton G. Barnett, Garrettsville, Ohio

[73] Assignee: Condar Co., Hiram, Ohio

[21] Appl. No.: 604,609

[22] Filed: May 1, 1984

Related U.S. Application Data

[63] Continuation of Ser. No. 413,502, Aug. 31, 1982, abandoned.

[51] Int. Cl.[3] ..... F23J 15/00

[52] U.S. Cl. ..... 110/214; 422/176; 110/210; 126/77; 126/86

[58] Field of Search ..... 110/203, 208, 210, 211, 110/213, 214, 235, 248, 251, 216–217, 301, 303; 422/176; 126/77, 83

[56] References Cited

U.S. PATENT DOCUMENTS

| | | | |
|---|---|---|---|
| 1,263,432 | 4/1918 | Kener | 110/214 |
| 1,970,923 | 8/1934 | Spalding | 423/533 |
| 2,879,862 | 3/1959 | Burden | 422/176 X |
| 3,560,165 | 2/1971 | Beasley | 422/176 X |
| 3,785,778 | 1/1974 | Burstein et al. | 422/176 X |
| 4,135,885 | 1/1979 | Wormser et al. | 422/176 X |
| 4,363,785 | 12/1982 | Willson | 110/214 X |
| 4,373,452 | 2/1983 | Van Dewoestine | 110/210 X |

FOREIGN PATENT DOCUMENTS

| | | | |
|---|---|---|---|
| 155110 | 12/1980 | Japan | 110/210 |
| 155109 | 12/1980 | Japan | 110/210 |

*Primary Examiner*—Henry C. Yuen

*Attorney, Agent, or Firm*—Fay & Sharpe

[57] ABSTRACT

An apparatus for placement in the effluent path of the combustible gases created by fuel burning in a combustion chamber and delivering such combustible gases to a catalyst is disclosed. A finned holder for placement downstream of the burning fuel is provided. The fins on the holder serve to create turbulence in the combustible gases emanating from the burning fuel. The holder also serves to support a secondary air introduction ring. The ring uniformly introduces preheated secondary air to the combustible gases through a plurality of ports in the ring thus forming a substantially homogeneous mixture of gases. The homogeneous mixture of gases is delivered to a catalyst located above and downstream of both the holder and ring.

12 Claims, 8 Drawing Figures

FIG. 2
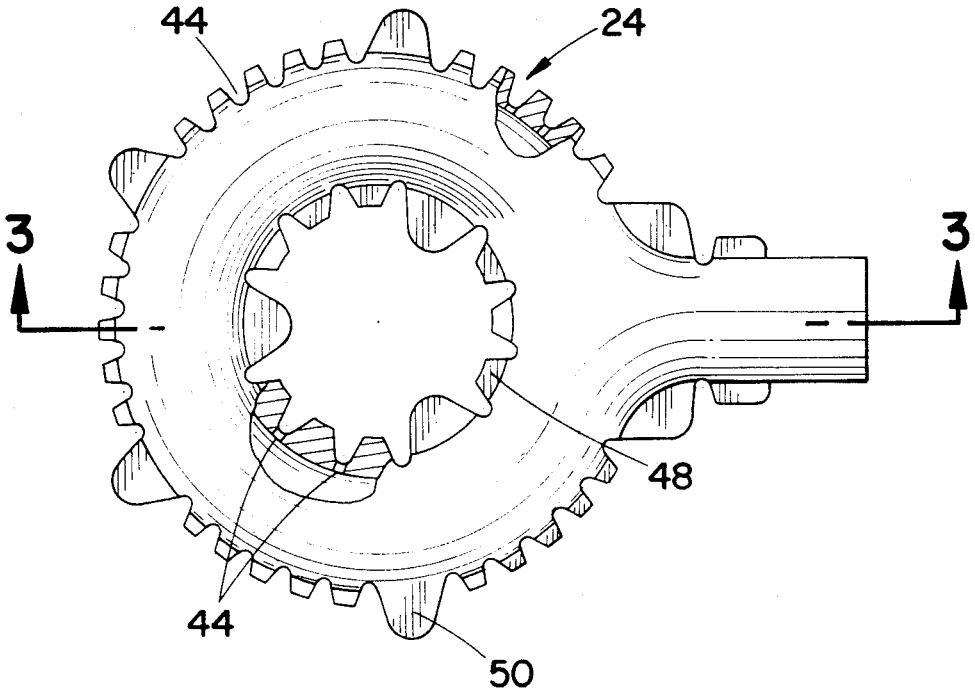
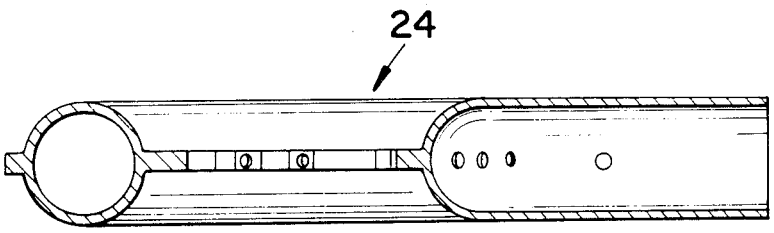
FIG. 3

FIG. 4
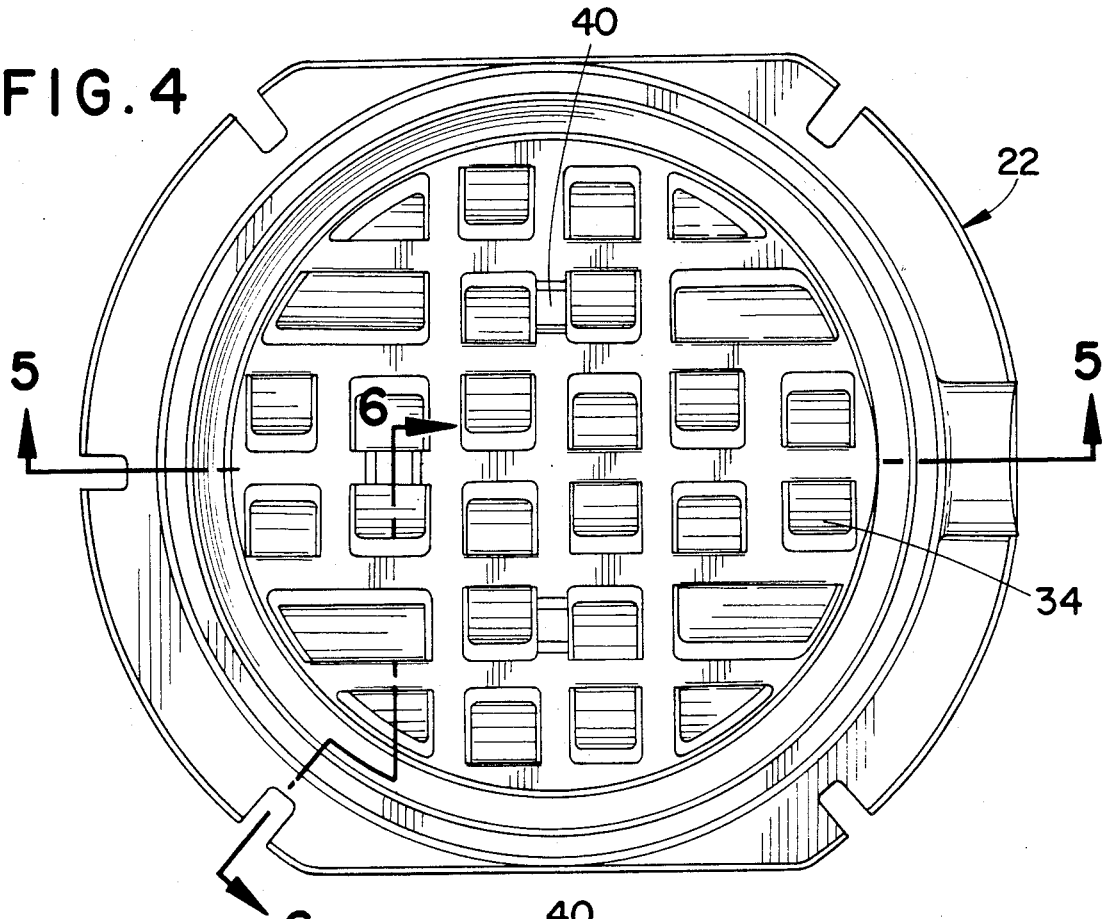
FIG. 6
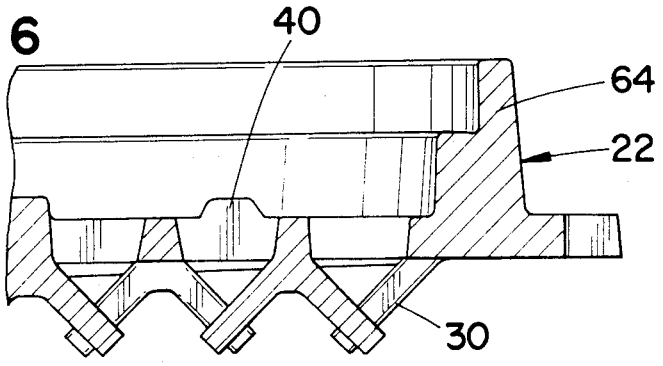
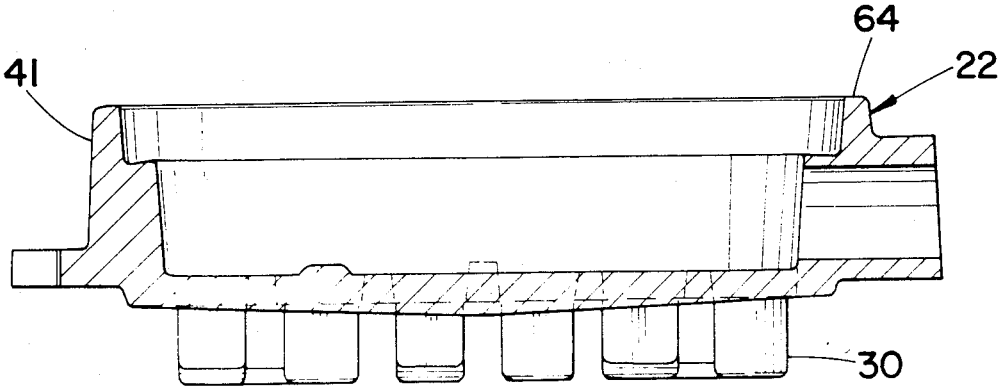
FIG. 5

COMBUSTION GAS MIXING APPARATUS

This application is a continuation of application Ser. No. 413,502, filed 8/31/82, now abandoned.

BACKGROUND OF THE INVENTION

This invention relates to the art of systems designed to more completely burn combustion gases emanating from a burning fuel. It particularly relates to systems which mix a secondary air source with combustion gases and then deliver that mixture to a catalyst.

DESCRIPTION OF THE PRIOR ART

In the prior art various systems are found for delivering combustion gases to a catalyst. These systems occasionally have employed a means to supply preheated secondary air to combustion gases before the secondary air and combustion gases entered the catalyst.

Generally, however, none of the apparatus found in the prior art provided a system by which the combustion gases and secondary air could be homogeneously mixed before delivery to the catalyst nor did previous systems take advantage of the heat energy radiated from the catalyst to achieve a combustion function in the mixture of gases even before they entered the catalyst.

Additionally, most systems failed to take advantage of the heat emanating from the firebox itself, as opposed to providing a secondary heat source, to preheat the secondary air.

Also, the delivery rate of the secondary air has been inadequately controlled and has not been uniform. Moreover, insufficient attention has been paid to preventing the secondary air flow from becoming restricted. These failures have contributed to the inefficiency found in systems which comprise the prior art.

SUMMARY OF THE INVENTION

Applicant's invention is an apparatus for delivering homogeneously mixed combustion and secondary air to a catalyst.

The invention is particularly adaptable to woodburning stoves, although it is certainly not limited to such applications. For instance, the apparatus could be adapted for mounting in a flue pipe for capturing gases for pollution control.

The catalyst with which applicant's invention is designed to function could be any of those which are now generally commercially available.

The apparatus and the method in which it is employed, serve to overcome the aforementioned shortcomings found in prior art apparatus and systems.

The invention is comprised of a finned holder which is normally placed above and downstream of the path of effluent emanating from a burning fuel. The finned holder creates turbulence in combustible gases generated by the burning fuel. Supported by the holder, and still further downstream, is a multi-ported secondary air delivery member. In the present invention, this member takes the form of a ring, although it could be of any suitable configuration. The system is designed so that the secondary air is preheated before its delivery above the holder and a flap or damper-like member may be employed to control the amount of secondary air which is to be mixed with turbulent combustible gases.

Overlying both the ring and the ring holder is a catalyst to which the homogeneously mixed combustible gases and secondary air are ultimately delivered.

The catalyst ring and holder are spaced from each other in such a manner that the catalyst and holder form a sealed chamber in which heat energy is transferred by radiation from the catalyst. This chamber also contains the ring through which the preheated secondary air is introduced.

The overall system is so designed that a secondary air supply tube is placed within or contiguous to the combustion chamber and secondary air flowing through the tube is preheated without the necessity of having a secondary heat source to accomplish the preheat function. Among other things, preheating the secondary air produces a positive draft through the secondary air supply tube. The secondary air supply tube and the ring are both configured in such manner that air flow is not restricted except for the intentional restriction created by the previously-mentioned flap which is adjustable for each installation to provide for fine tuning.

The ports contained within the ring are of varying diameters so that an even secondary air flow is introduced in the chamber between the holder and catalyst. One benefit of applicant's apparatus and system is that it provides an optimum delivery of gases containing unburned chemical compounds, mixed with preheated secondary combustion air to a catalyst. The invention results in increasing efficiency by 10–20 percentage points relative to the methods and apparatus now employed to deliver gas to these same catalysts. It is an object of the apparatus and system to remove 95%–98% or more of the particulates, combustible gases and creosote emanating from a fuel source and to reduce carbon monoxide levels to less than 0.10%.

Other objects, benefits and advantages of applicant's apparatus and system method will become apparent upon a reading and understanding of the drawings and detailed description of the invention.

BRIEF DESCRIPTION OF THE DRAWINGS

The preferred embodiment of the invention is illustrated in the accompany drawings in which:

FIG. 2 is a top view of the ring;

FIG. 3 is a view taken along line 3—3 of FIG. 2;

FIG. 4 is a top view of the ring holder;

FIG. 5 is a view taken along line 5—5 of FIG. 4;

FIG. 6 is a view taken along line 6—6 of FIG. 4;

DETAILED DESCRIPTION OF THE INVENTION

Figure 1:
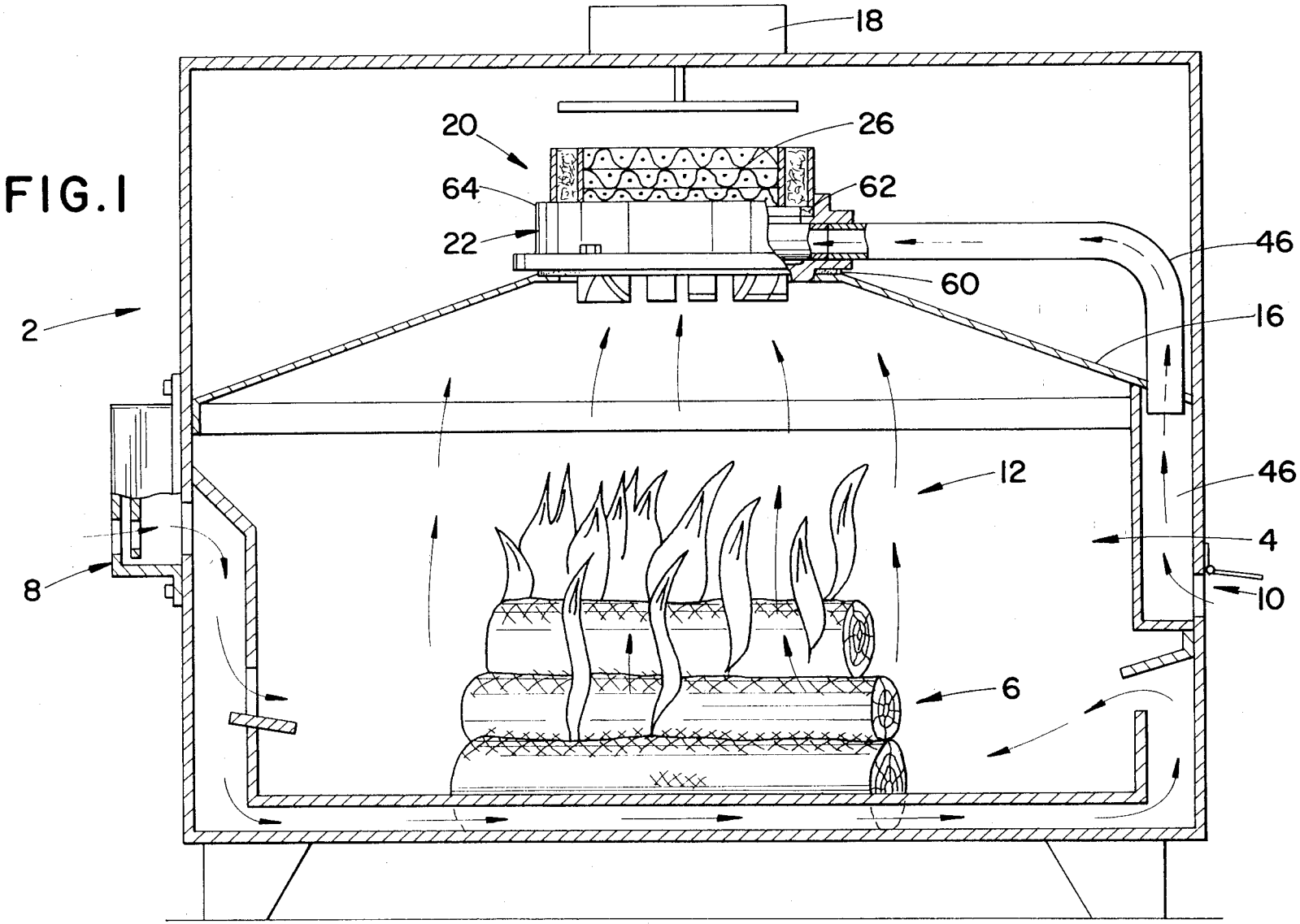
FIG. 1 is a side cross-sectional view of a stove embodying applicant's apparatus and system.

With reference now to the drawings which illustrate the preferred embodiment of the invention but which are not supplied for the purposes of limiting the same, FIG. 1 shows a catalytic stove 2 in which applicant's apparatus has been installed and in which its system and method of removing particulates and substantially burning combustible gases have been employed.

The stove comprises a combustion chamber 4, a fuel 6, a primary air supply path 8, and a secondary air supply path 10.

Figure 7:
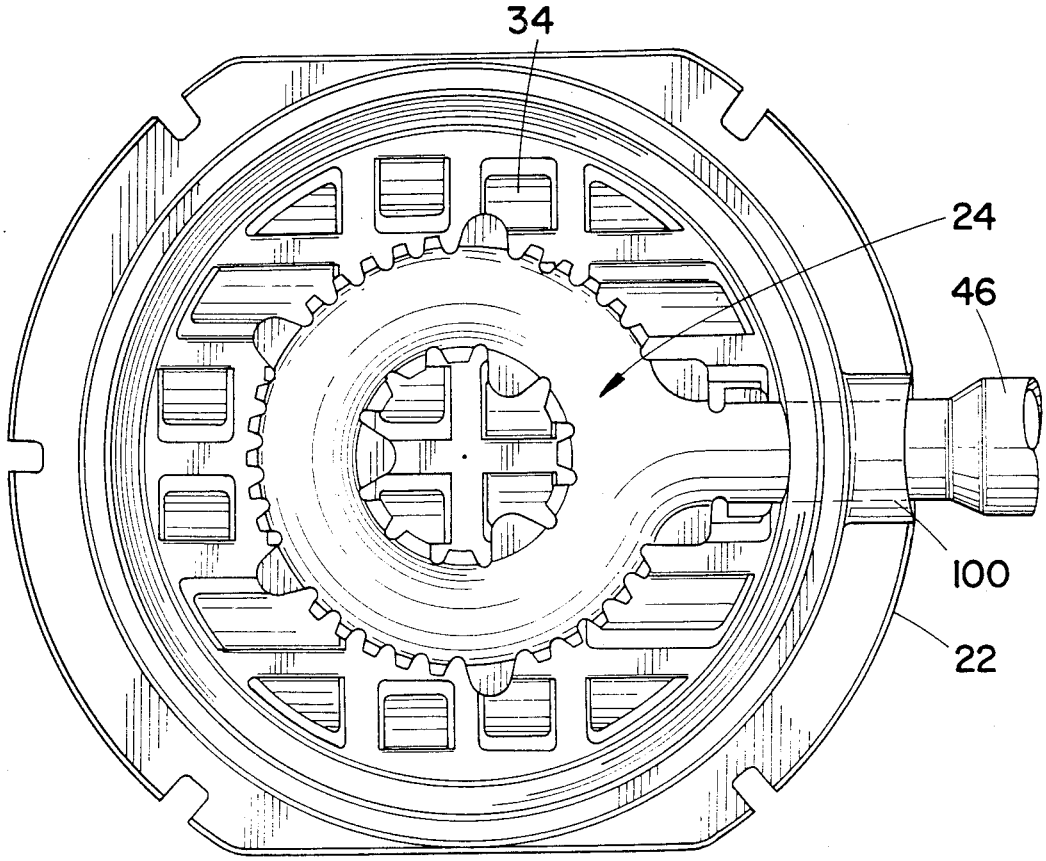
FIG. 7 is a top view of the assembled ring and holder.
Figure 8:
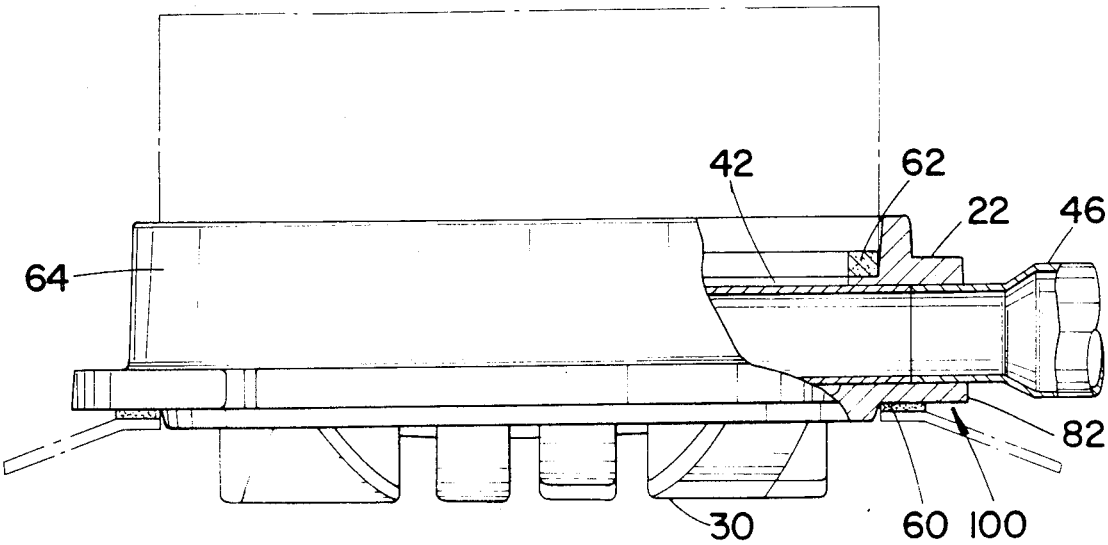
FIG. 8 is a side view, partially in section, of the invention as it would be installed at the top of a catalytic stove.

When the fuel is burned, combustible gases containing unburned chemical compounds rise in the direction of arrows 12 toward the top of the combustion chamber. When the combustible gases are still within the combustion chamber, it is best to limit their turbulence as much as possible so that they do not condense and form droplets. Thus, it is preferred that a fairly smooth walled combustion chamber, such as that shown, be employed. The chamber is so configured that combustible gases are directed in a fairly smooth path to the sloping top walls 16 of the combustion chamber. Once reaching the top of the chamber, however, and before allowing the gases to exit the stove through flue 18, it is desirable to provide a means for removing as much of the unburned chemical compounds and particulates as possible from the combustible gases. In order to accomplish this, applicant has placed a mixer and fuel burning assembly 20 at the top of the combustion chamber above the burning fuel. The view in FIG. 1, when taken in conjunction with the view of FIGS. 7 and 8, best illustrates the placement of this assembly in the stove.

The assembly is comprised of a holder 22, a ring element 24 and a catalyst 26.

As previously mentioned, when the combustible gases are still within the combustion chamber, it is best that they flow fairly smoothly to prevent them from condensing. Once, however, the gases reach the point at which they are to exit the combustion chamber, this is no longer the case. At this point, it is desirable to introduce preheated secondary air to the combustible gases, thoroughly mix this secondary oxygen rich air with the combustible gases and pass the resulting homogeneous mixture through a catalyst. To obtain turbulence, the holder 22 has been provided with a plurality of downwardly extending fins 30. When the combustible gases reach these fins, severe turbulence in the combustible gases rising from the combustion chamber is produced. This agitated combustion gas rises through apertures 34 in the holder and into a small chamber 42 formed between and by the holder and the catalyst. Within this chamber and spaced slightly above the apertured portion of the holder by bosses 40 is the ring 24 for dispersing the secondary air. The walls 41 of the holder form a coupling 100 to secure the ring so that it is substantially centered in the holder.

In the illustrations, the ring is substantially annular although it could be of any suitable configuration which would provide a substantially even distribution of secondary air in the chamber 42. To accomplish this even air distribution in the preferred embodiment, holes or apertures 44 are provided around the interior and exterior peripheries of the ring. These apertures are graduated in size such that the amount of air that is ejected from each is uniform. Thus, in the embodiment which is shown, the holes furthest from the secondary air tube 46 are generally larger than the apertures which lie closer to the source of the secondary air supply.

The ring is supplied with a number of fins 48 located between each outlet hole. These fins serve to further heat and turbulate the gases and also serve the additional function of providing a seal between the holes.

Parenthetically, the larger tabs 50 are provided to enable spot welding equipment to join the ring together since it is generally first produced in two matching halves, the holes being cut into each of the two halves.

When the entire apparatus is installed in the combustion chamber, it is best to place a gasket 60 between the unit and the top wall of the combustion chamber. In order to maximize the mixing of the combustible gases and the secondary air, it is also desirable to place a gasket 62 between the wall 64 of the holder and the catalyst.

As has been mentioned, it is found to be desirable to preheat the secondary air. In applicant's method, this has been accomplished by passing tubes 46 through at least a portion of the combustion chamber. This could have been accomplished, of course, by placing the secondary air supply means in a variety of contiguous relationships with the combustion chamber. The objective is to utilize the heat generated by the burning fuel to preheat the secondary air, thus obviating the necessity of providing a secondary heat source.

When the stove is in operation, primary combustion air is provided to the fuel in the combustion chamber. The fuel is then partially burned and gases containing unburned chemical compounds which emanate from the fuel are directed to the baffled ring holder at which point turbulence is produced in the gases. The gases then rise through the holder because of the draft produced by the hot gases and the flue or stack. Secondary combustion air which has been preheated by its passage through a tube in the catalytic or secondary combustion chamber is then introduced through the ring or secondary air discharge member which is located above, and is supported by, the holder. It is best to space the ring a small distance from the top of the fins to allow the wall effect to take place so that turbulent combustion gas flows freely around the ring and mixes with the fresh oxygen that is being emitted by induced draft from the multiple holes in the ring. Thus, mixing of the primary and secondary combustion gases occurs, and this mixture is then introduced into the catalyst.

It has been found that, due to the fact that the invention produces a catalytic operating temperature which is often in the range of 1000° to 1800° F., some heat energy is transferred by radiation to the chamber where the ring is located. This occasionally produces "precombustion" in this chamber at high burn rates. The high catalytic converter heat is thus transferred to the ring chamber, the ring and ring fins and also to the baffled holder or bottom plate thereby further heating the incoming gases and air.

It should be noted that it may be desirable to provide for variably controlling the amount of secondary air that is introduced through the ring, i.e., fine tuning the apparatus. This can be accomplished by means of a damper or with a flap in the secondary air supply channel. This modification has been illustrated in a specific position but it may be placed at most any convenient location in the secondary air supply path.

Thus it can be seen that the invention comprises not only an apparatus but a method by which particulate and combustible gas removal can be accomplished. The combination of a finned holder in which the fins are preferably extended downwardly at an angle of between 40°-50°, a secondary air introduction member having graduated apertures to evenly distribute preheated secondary air and a conventional catalyst can be utilized to effect substantially better results than have been achieved by prior art apparatus and systems.

It should also be realized that although in the preferred embodiment the lower edge 82 of the holder is secured to the top of the combustion chamber the particular configuration could be altered to accommodate different types of installations. These other installations would include at least a retrofit type unit for use on the top of or within the top of an existing stove, or the apparatus could be mounted in a flue pipe for capturing gases in pollution control systems. These types of adaptations of the instant invention are anticipated by the applicant. One of the more desirable characteristics of applicant's apparatus is that it is fairly compact. The combination of a multi-ported finned ring and baffled holder enable air and combustible gases to be substantially homogeneously mixed for more complete burning in the chamber between the catalyst and the holder, as well as in the catalyst itself.

Having thus described the invention with particular reference to the preferred embodiment, it is obvious that modifications and alterations will occur to others upon a reading and understanding of the specification. It is the intention of applicant to include all such modifications and alterations insofar as they come within the scope of the appended claims.

What is claimed is:

1. An effluent gas burning apparatus adapted to be placed downstream of a primary combustion chamber, which burns a fuel with primary combustion air, to burn in a secondary combustion the effluent gas of the primary combustion chamber, comprising:

an apertured holder positioned downstream of an associated primary combustion chamber and adapted to have the effluent gas flow through a plurality of apertures thereof, said holder including a plurality of integral fins for creating turbulence in the effluent gas flowing through said holder;

a secondary combustion air delivery member which is positioned within said holder and downstream of said fins, said delivery member including a plurality of spaced apertures through which secondary combustion air is introduced into the effluent gas, said apertures being graduated in size becoming progressively larger the further they are positioned from said inlet port to evenly distribute said secondary combustion air and create a homogeneous mixture of said effluent gas and said secondary combustion air; and, a catalytic combustor positioned downstream of said delivery member for combusting said homogenous mixture.

2. The apparatus of claim 1 wherein said delivery member is provided with a plurality of fins jutting into the path of the effluent gas streaming therepast to enhance the mixing of said secondary air with the effluent gas.

3. A method of delivering gases containing unburned chemical compounds to a catalyst for subsequent combustion comprising the procedural combination of steps of:

providing a primary combustion air source to a fuel contained in a combustion chamber;

burning the fuel thereby producing combustion gases containing unburned chemical compounds;

directing the gases to a plurality of finned turbulence causing members which produce turbulence in the gases;

subsequently introducing a plurality of streams of secondary air through an apertured air discharge member located downstream of said finned members which produce turbulence;

providing a plurality of differently sized apertures in said apertured discharge member so that a uniform volume of said secondary air is ejected through each of said plurality of apertures of said apertured air discharge member;

homogeneously mixing the plurality of streams of secondary air with the combustion gases; and, subsequently introducing the mixed secondary air and combustion gases into the catalyst.

4. The method of claim 3 further comprising the step of transferring heat energy by radiation from the catalyst to the area in which the secondary air is discharged.

5. The method of claim 3 further comprising the step of introducing the secondary air through a secondary air supply tube, then through at least a portion of the combustion chamber to heat the secondary air, and then into the secondary air discharge member.

6. The method of claim 3 further comprising the step of variably controlling the amount of secondary air introduced through the secondary air discharge member.

7. An effluent gas burning apparatus adapted to be placed downstream of a primary combustion chamber, which burns a fuel with primary combustion air, to burn in a secondary combustion the effluent gas of the primary combustion chamber, comprising:

an apertured holder positioned in an outlet port of an associated primary combustion chamber and adapted to have the effluent gas flow through a plurality of apertures thereof, said holder including a plurality of integral fins for creating turbulence in the effluent gas flowing through said holder;

a secondary combustion air delivery member which is positioned within said holder and downstream of said fins, said delivery member including a plurality of spaced apertures through which secondary combustion air is introduced into the effluent gas to create a homogeneous mixture of said effluent gas and said secondary combustion air wherein said secondary air delivery member is ring-shaped and wherein said ring is provided with apertures on both its inner and outer peripheries and wherein said ring has an inlet orifice and wherein said apertures on said ring become progressively larger as they become more distant from said inlet orifice whereby the same amount of air is delivered through each aperture into the effluent gas; and, a catalytic combustor positioned downstream of said delivery member and supported by said holder for combusting said homogeneous mixture.

8. The apparatus of claim 7 wherein a gasket is positioned between said catalytic combustor and said holder.

9. The apparatus of claim 7 wherein said apertured holder is positioned on and supported by a top wall of the combustion chamber.

10. The apparatus of claim 7 wherein said fins of said holder are disposed at an angle of approximately 40° to 50° in relation to a vertical axis passing through said holder.

11. The apparatus of claim 7 wherein said ring is provided with fins which jut into the path of the effluent gas streaming past said ring to further cause turbulence in the mixture of effluent gas and secondary air.

12. The apparatus of claim 7 wherein said secondary air is preheated by the effluent gas before being introduced into the effluent gas due to the positioning of said delivery member in said holder.

* * * * *